US006915867B2

(12) United States Patent
Bise

(10) Patent No.: US 6,915,867 B2
(45) Date of Patent: Jul. 12, 2005

(54) EARTH PENETRATING ROTARY DRILL BIT WITH HELICAL PORTS

(75) Inventor: Douglas E. Bise, Chilhowie, VA (US)

(73) Assignee: Kennametal Inc., Latrobe, PA (US)

( * ) Notice: Subject to any disclaimer, the term of this patent is extended or adjusted under 35 U.S.C. 154(b) by 70 days.

(21) Appl. No.: 10/610,112

(22) Filed: Jun. 30, 2003

(65) Prior Publication Data

US 2004/0262045 A1 Dec. 30, 2004

(51) Int. Cl.[7] ..... E21B 10/31
(52) U.S. Cl. ..... 175/420.1; 175/418
(58) Field of Search ..... 175/413, 417, 175/418, 420.1

(56) References Cited

U.S. PATENT DOCUMENTS

| | | | | |
|---|---|---|---|---|
| 2,578,593 | A | | 12/1951 | Phipps |
| 3,163,246 | A | | 12/1964 | Vagins et al. |
| 4,189,013 | A | | 2/1980 | Adams et al. |
| 4,190,128 | A | | 2/1980 | Emmerich |
| 4,216,832 | A | | 8/1980 | Stephenson et al. |
| 4,330,044 | A | | 5/1982 | Orr et al. |
| 4,352,400 | A | | 10/1982 | Grappendorf et al. |
| 4,446,936 | A | | 5/1984 | Sarin et al. |
| 4,488,609 | A | | 12/1984 | Sarin |
| 4,492,278 | A | | 1/1985 | Leighton |
| 4,515,230 | A | | 5/1985 | Means et al. |
| 4,527,931 | A | | 7/1985 | Sarin |
| 4,550,791 | A | | 11/1985 | Isakov |
| 4,605,079 | A | | 8/1986 | Leibee et al. |
| 4,712,626 | A | | 12/1987 | Shaw |
| 5,180,022 | A | | 1/1993 | Brady |
| 5,220,967 | A | | 6/1993 | Monyak |
| 5,287,937 | A | | 2/1994 | Sollami et al. |
| 5,303,787 | A | | 4/1994 | Brady |
| 5,400,861 | A | | 3/1995 | Sheirer |
| 5,429,199 | A | | 7/1995 | Sheirer et al. |
| 5,452,628 | A | * | 9/1995 | Montgomery et al. ..... 76/108.2 |
| 5,458,210 | A | | 10/1995 | Sollami |
| 6,145,606 | A | | 11/2000 | Haga |
| 6,595,305 | B1 | | 7/2003 | Dunn et al. |
| 6,684,968 | B2 | * | 2/2004 | Bise et al. ..... 175/427 |

OTHER PUBLICATIONS

GE Carboloy Mining Tools Catalog No. MT7–241, Effective Sep. 1, 1977.
Sitler, "Manufactured Diamond and Enhanced Mining Tool Performance", Soc. of Mining Engineers AIME.
Rotary and Rotary Percussive Drilling Tools, WIMET Mining Catalog (unknown date).
Kennametal "The Mining Tool Authority" Catalog 2000.
International Search Report of PCT/US2004/018289, mailed Oct. 5, 2004.

* cited by examiner

*Primary Examiner*—William Neuder
(74) *Attorney, Agent, or Firm*—Matthew W. Smith

(57) ABSTRACT

A drill bit that has a drill bit body with a side wall and opposite ends. A distal one of the opposite ends of the drill bit body receives a cutting insert. The drill bit body contains at least two helical debris ports in the side wall thereof. The drill bit body further contains a helical scallop that corresponds to each one of the helical debris ports. Each one of the helical scallops surrounds so as to define the periphery of its corresponding one of the helical debris ports.

30 Claims, 4 Drawing Sheets

EARTH PENETRATING ROTARY DRILL BIT WITH HELICAL PORTS

BACKGROUND OF THE INVENTION

The invention pertains to an earth penetrating rotary drill bit that has a hard member at the axial forward end thereof. More specifically, the invention pertains to an earth penetrating rotary drill but that has a hard member at one end thereof and wherein the rotary drill bit contains debris (or dust) ports for evacuating dust and debris from the vicinity of the drilling operation.

The expansion of an underground coal mine requires digging a tunnel that initially has an unsupported roof. To provide support for the roof, an earth penetrating rotary drill bit (e.g., a roof drill bit) is used to drill boreholes, which can extend from between about two feet to about (or even greater than) twenty feet, into the earth strata. In this regard, the earth penetrating drill bit is connected to a drill steel. The drill steel is connected to a rotary driver. The rotary driver powers the earth penetrating drill bit so as to drill the earth strata. Roof bolts are affixed within the boreholes and a roof support (e.g., a roof panel) is then attached to the roof bolts. Examples of a conventional roof drill bit with an axial forward slot that carries a blade style hard insert are the KCV4-1RR and KCV4-1 1/32RR Roof Rocket™ drill bits made by Kennametal Inc. of Latrobe, Pa., USA and shown in U.S. Pat. No. 5,172,775 to Sheirer et al.

During the drilling operation, rotary drill bits generate debris. This debris can take the form of dust-like fine particles. The debris may also exist as larger particles. During the drilling operation, this debris is evacuated under the influence of a vacuum from the vicinity of the drilling operation through debris ports (or dust ports) contained in the body of the rotary drill bit. On occasion during the drilling operation, a rotary drill bit can generate a large enough volume of debris such that the rotary drill bit is unable to evacuate the debris quickly enough from the vicinity of the drilling operation to maintain the efficient operation of the rotary drill bit. When the debris cannot be adequately evacuated from the vicinity of the drilling operation, several consequences can occur.

One such consequence is that the speed at which the rotary drill bit operates, and hence the drilling rate, must be reduced so as to accommodate the debris. By reducing the speed of the rotary drill bit due to the inability of the rotary drill bit to evacuate debris, the operator is limited in being able to operate the rotary drill bit at its optimum capability. It would be desirable to provide an improved rotary drill bit that better evacuates drilling debris so as to enhance the ability of the rotary drill bit to operate at a higher speed.

Another such consequence of the inability to adequately evacuate debris from the vicinity of the drilling operation is that the rotary drill bit tends to stick in the bore hole. This causes the drilling operation to become less consistent and rougher. It would thus be advantageous to provide an improved rotary drill bit that better evacuates drilling debris from the vicinity of the drilling operation so as to provide for the smoother operation of the rotary drill bit.

Yet another such consequence of the inability to adequately evacuate debris from the vicinity of the drilling operation is that the rotary drill bit tends to overheat. This is due to the presence of drilling debris that increases the friction between the rotary drill bit and the earth strata (included the debris). It would thus be advantageous to provide an improved rotary drill bit that better evacuates drilling debris from the vicinity of the drilling operation so that the rotary drill bit operates cooler, i.e., operates at lower temperature.

Overall, it can be seen that there would be a number of advantages associated with being able to provide an improved earth penetrating rotary drill bit that is able to better evacuate debris from the vicinity of the drilling operation. The advantages include allowing for the rotary drill bit to smoothly operate at higher drilling rates and yet still be at a lower operating temperature.

SUMMARY OF THE INVENTION

In one form thereof the invention is a drill bit for drilling earth strata whereby debris is generated during the drilling operation. The drill bit comprises a drill bit body that has a side wall and opposite ends wherein a distal one of the opposite ends of the drill bit body receives a cutting insert. The drill bit body contains a helical debris port in the side wall thereof and a helical scallop surrounds the debris port. The helical scallop is proximate to the cutting insert so that debris from the drilling operation impinges upon the helical scallop whereby the helical scallop directs the debris into the helical debris port.

In yet another form thereof, the invention is a drill bit for drilling earth strata so as to generate debris. The drill bit comprises a drill bit body that has a side wall and opposite ends wherein a distal one of the opposite ends of the drill bit body receives a cutting insert. The drill bit body contains a helical debris port in the side wall thereof and a helical scallop surrounds the debris port. The distal end of the drill bit body presents a feeder surface wherein the feeder surface is adjacent to the cutting insert. Debris from the drilling operation impinging upon the feeder surface so that the feeder surface feeds the debris into the helical scallop whereby the helical scallop directs the debris into the helical debris port.

In yet another form thereof, the invention is a drill bit that comprises a drill bit body that has a side wall and opposite ends wherein a distal one of the opposite ends of the drill bit body receives a cutting insert. The drill bit body contains at least two helical debris ports in the side wall thereof, and a helical scallop corresponding to each one of the helical debris ports. Each one of the helical scallops surrounds its corresponding debris port so as to define the periphery thereof.

In still another form thereof, the invention is a drill bit that comprises a drill bit body that has a side wall and opposite ends wherein a distal one of the opposite ends of the drill bit body receives a cutting insert. The drill bit body contains a helical debris port in the side wall thereof. The drill bit body contains a helical scallop surrounding each one of the helical debris ports wherein the scallop defines a periphery of the debris port. The helical scallop has a pitch ranging between about 3 inches (about 7.62 centimeters) and about 15 inches (38.1 centimeters).

In one form thereof, the invention is a cold-formed rotary drill bit body that comprises a side wall wherein the side wall contains a helical scallop and the helical scallop presents a pitch ranging between about 3 inches (about 7.62 centimeters) and about 15 inches (38.1 centimeters). The side wall contains a helical debris port wherein the helical scallop surrounds the helical debris port. The bit body further includes opposite ends wherein a distal one of the opposite ends containing a slot for receiving a cutting insert.

In yet another form thereof the invention is a cast rotary drill bit body that comprises a side wall wherein the side wall contains a helical scallop and the helical scallop presents a pitch ranging between about 3 inches (about 7.62 centimeters) and about 15 inches (38.1 centimeters). The side wall contains a helical debris port wherein the helical scallop surrounds the helical debris port. The bit body further includes opposite ends wherein a distal one of the opposite ends containing a slot for receiving a cutting insert.

In another form thereof the invention is a method of making a rotary drill bit body comprising the steps of: providing a rotary drill bit body blank wherein the rotary drill bit body blank is either cast or sold-formed, and the rotary drill bit body blank having a helical scallop, and the rotary drill bit body blank further having a distal end containing a plug and a formed protrusion within the helical scallop; removing the plug so as to form a slot for receiving a cutting insert; and removing the formed protrusion so as to form a helical debris port.

In still another form thereof, the invention is a method of making a rotary drill bit comprising the steps of: providing a drill bit body having a side wall and opposite ends, the drill bit body containing a helical debris port in the side wall thereof, and the drill bit body containing a helical scallop surrounding the debris port; providing a cutting insert; and affixing the cutting insert to the drill bit body at a distal one of the opposite ends thereof so that the helical scallop is proximate to the cutting insert so that debris from the drilling operation impinges upon the helical scallop whereby the helical scallop directs the debris into the helical debris port.

BRIEF DESCRIPTION OF THE DRAWINGS

The following is a brief description of the drawings that from a part of this patent application.

DETAILED DESCRIPTION OF THE INVENTION

Figure 1:
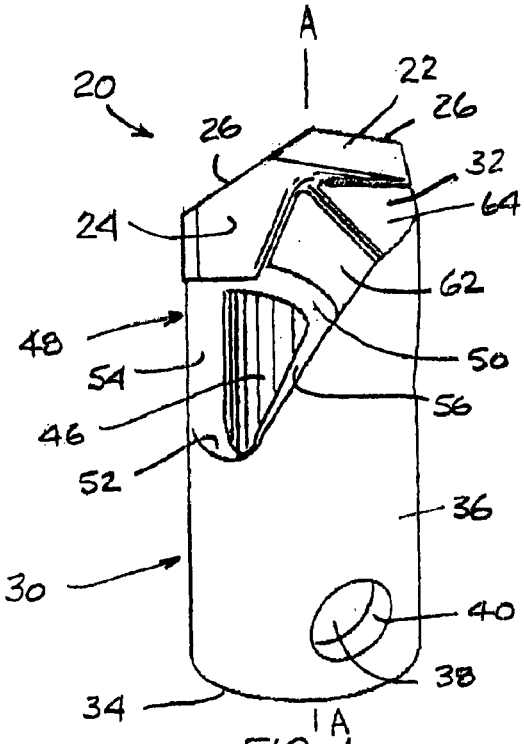
FIG. 1 is an isometric view of one specific embodiment of the earth penetrating rotary drill bit of the invention.
Figure 2:
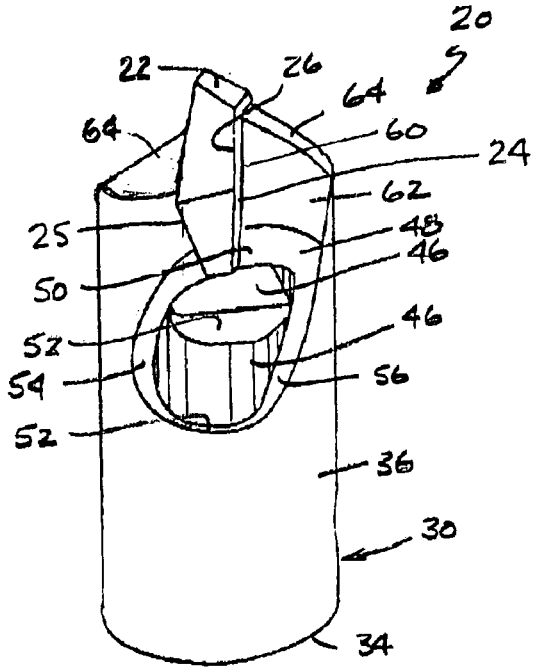
FIG. 2 is an isometric view of the specific embodiment of the earth penetrating rotary drill bit of FIG. 1 wherein the drill bit is rotated in a counter-clockwise direction as shown in the drawings.
Figure 5:
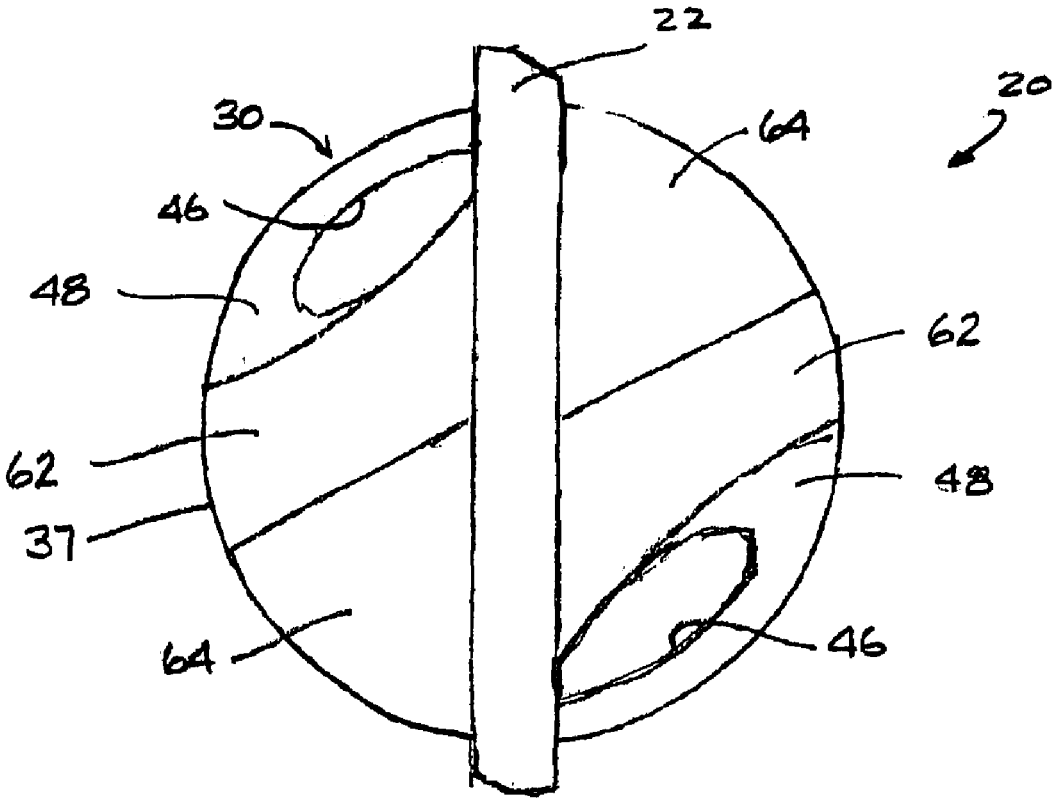
FIG. 5 is a top view of the earth penetrating rotary drill bit of FIG. 1.

Referring to the drawings, in FIGS. 1, 2 and 5 there is shown a first specific embodiment of the earth penetrating rotary drill bit generally designated as 20. Rotary drill bit 20 has a central longitudinal axis A—A a shown in FIG. 1. The rotary drill bit 20 is a roof bit and functions as a drill bit for drilling earth strata whereby debris is generated during the drilling operation. As will be described in more detail hereinafter, the debris is evacuated from the vicinity of the drilling operation (i.e., from the vicinity of the drill bit) through debris (or dust ports) under the influence of a vacuum. Rotary drill bit 20 includes a hard carbide (e.g., cobalt cemented tungsten carbide) cutting insert 22 that presents opposite surfaces that comprise a leading surface 24 and a trailing surface 25. The cutting insert 22 also presents a cutting edge 26.

Rotary drill bit 20 further includes an elongate steel bit body generally designated as 30. Bit body 20 has a distal end (or top end) 32 and a proximate end (bottom end) 34. Bit body 30 further includes a generally cylindrical side wall 36 that presents a cylindrical exterior surface 37 and contains aperture 40 therein. Bit body 30 further defines an interior cavity 38. As is well known in the art, a projection on the drill steel registers with the aperture 40 so as to connect drill steel to the rotary drill bit.

Bit body 30 contains a helical debris port 46 that is elongate (or helical) in shape. The bit body 30 further contains a helical scallop 48. Helical scallop 48 surrounds the helical debris port 46 so as to define the perimeter of the helical debris port 46.

The helical scallop 48 shown in rotary drill bit 20 has an orientation so as to have a pitch that equals about 7.3 inches (18.54 centimeters). The helical scallop 48 may have a pitch that ranges between about 3 inches (7.62 centimeters) and about 15 inches (38.1 centimeters). As an alternative range for the pitch, the helical scallop 48 may have a pitch that ranges between about 5 inches (12.7 centimeters) and about 10 inches (25.4 centimeters). As still another alternate range for the pitch, the helical scallop 48 may have a range of the pitch between about 6 inches (15.24 centimeters) and about 10 inches (25.4 centimeters). The orientation of the helical debris port 46 is such so that it has a pitch like that of the helical scallop 48.

Helical scallop 48 is defined by contiguous surfaces that comprise a top (or axial forward) surface 50, a bottom (or axial rearward) surface 52, and opposite side surfaces 54 and 56. The top surface 50 is generally parallel to the major axis of the helical debris port 46. The one side surface 54 is contiguous with the top surface 50, but is twisted relative to the top surface 50. The other side surface 56 is contiguous with the top surface 50 and has an orientation so as to be generally parallel to the top surface 50. The bottom surface 52 is contiguous with the side surfaces (54, 56), and is oriented so as to face somewhat inwardly toward the cavity 38.

Referring to FIG. 2, it can be seen that the cutting insert 22 and the helical debris port 46 are axially spaced apart in that the cutting insert 22 is axial forward of the helical debris port 46. However, the cutting insert 22 and the helical debris port 46 have a relative vertical orientation so that the helical debris port 46 is on either side (i.e., leading side 24 and trailing side 25) of the cutting insert 22. In this regard, the trailing surface 25 of the cutting insert 22 is rotationally ahead of (i.e., offset in a counter-clockwise rotational direction a shown in FIG. 2 relative to) the rear edge of the helical debris port 46 that is defined by the one side surface 54 of the helical scallop 48. The leading surface 24 of the cutting insert 22 is rotationally behind of (i.e., offset in a clockwise rotational direction as shown in FIG. 2 relative to) the forward edge of the helical debris port 46. What this shows is that vertical downward extensions of the planes in which the leading side surface 24 and the trailing side surface 25 lie will intersect the helical debris port 46. One may characterize this relative positioning as the cutting insert having a vertical orientation relative to the helical debris port so as to be within the vertical extension of the periphery of the helical debris port.

Bit body 30 contains a transverse slot 60 therein at the top end 32 thereof. The transverse slot 60 receives the cutting insert 22. Cutting insert 22 may be affixed within the slot 60 by brazing or the like. Bit body 30 further includes a feeder surface 62 and an inclined surface 64. The feeder surface 62 is adjacent to the inclined surface 64.

In operation, the rotary drill bit 20 is pressed against the earth strata and is driven so as to rotate about its central longitudinal axis. The cutting insert 22 is in direct contact against the earth strata so as to drill a borehole. As a consequence of drilling the borehole, there is generated a volume of debris in the form of fine particles (i.e., dust) and larger particles. The debris is generated at, and hence initially located in, the vicinity of the cutting insert and the upper region of the rotary drill bit.

A vacuum is at the helical debris port 46. Under the influence of the vacuum, the debris moves over the feeder surface 62 and along the helical scallop 48 into the corresponding helical debris port 46. The helical orientation of the debris port 46 and the helical scallop 48 facilitate the efficient and relatively quick evacuation of the debris from the vicinity of the rotary drill bit 20. The efficient and relatively quick evacuation of the debris from the vicinity of the rotary drill bit 20 provides for the advantages of higher drilling rates along with smoother drilling and cooler drilling.

Figure 3:
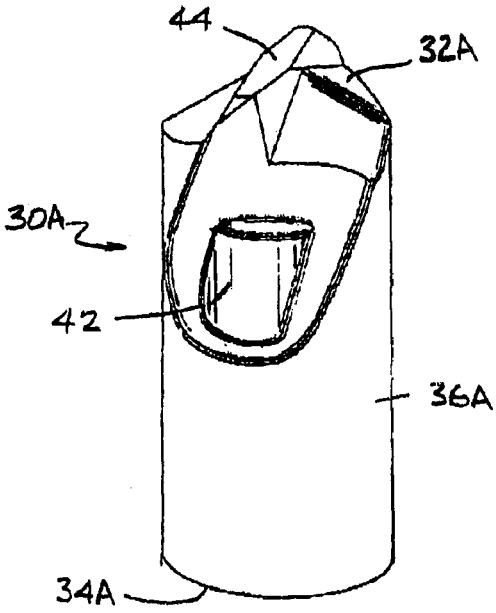
FIG. 3 is an isometric view of a cold-formed elongate drill bit body used to make an earth penetrating rotary drill bit like the earth penetrating rotary drill bit of FIG. 1 wherein the drill bit is illustrated prior to machining the slot that receives the cutting insert and prior to the completion of drilling the helical debris ports.
Figure 4:
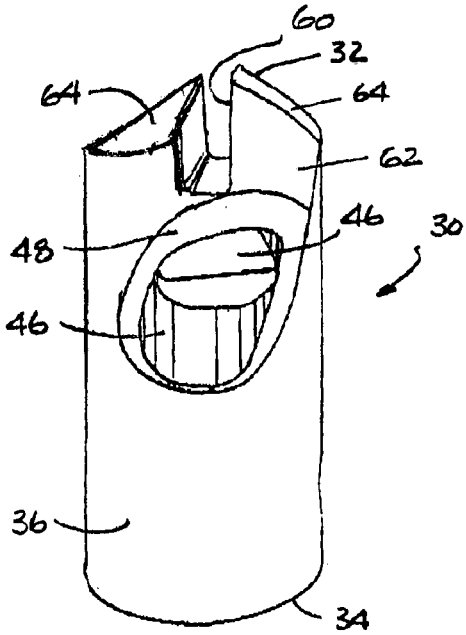
FIG. 4 is an isometric view of the cold-formed elongate drill bit body of FIG. 3 after machining the slot that receives the cutting insert and after completion of drilling the helical debris port.

Referring to FIGS. 3 and 4, in FIG. 3 there is shown a cold-formed steel bit body blank 30A used to make a rotary drill bit like that of rotary drill bit 20. The cold-formed bit body blank 30A contains a plug 44 that is in the general shape of a cutting insert. The bit body blank 30A also presents a formed protrusion 42 in the sidewall thereof.

As shown in FIG. 4, to finish the bit body blank 30A, the plug 44 is machined out (i.e., material is removed) to form a slot 60 and the bit body blank is drilled out (i.e., material is removed) in the area of the formed protrusion 42 to form the helical debris port 46.

Thus, it can be seen that the bit body 30 is made according to the following steps. First, there is the step of providing a cold-formed bit body blank that has a helical scallop, a plug in the location where there will be the cutting insert, and a formed protrusion within the helical scallop and at the location where there will be a helical debris port. Second, there is the step of machining out the plug (i.e., removing material) to form a slot that receives the cutting insert. Third, there is the step of drilling out the bit body in the location of the formed protrusion (i.e., removing material) so as to form the helical debris port.

It should also be appreciated that while the bit body is described as being cold-formed, applicant contemplates that the bit body could be cast.

Figure 6:
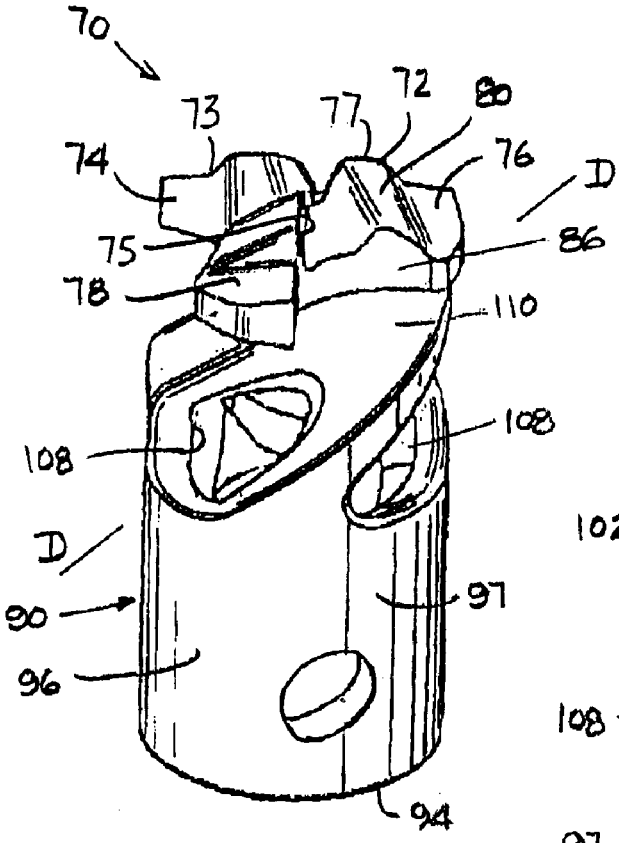
FIG. 6 is an isometric view of another specific embodiment of the earth penetrating rotary drill bit of the invention wherein this embodiment has a lobed cutting insert.
Figure 7:
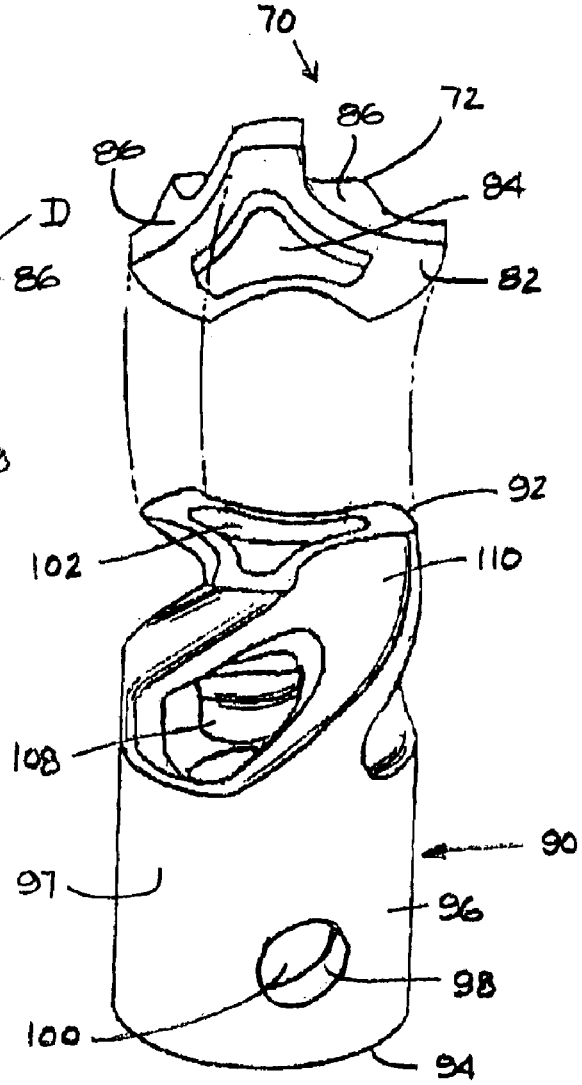
FIG. 7 is an isometric view of the earth penetrating rotary drill bit of FIG. 6 wherein the lobed cutting insert is exploded away from the elongate rotary drill bit body so as to view the bottom surface of the cutting insert.

Referring to FIGS. 6 and 7, there is shown another embodiment of a rotary drill bit generally designated as 70. Rotary drill bit 70 includes a hard carbide (e.g., cobalt cemented tungsten carbide) cutting insert 72. Cutting insert 72 has a trio of lobes 74, 76, 78 wherein each one of the lobes 74, 76, 78 presents a cutting edge 73, 75 77, respectively, on the top surface 80 of the cutting insert 72. Cutting insert 72 has a bottom surface 82 wherein a lobed projection 84 extends from the bottom surface 82. The cutting insert 72 has a trio of arcuate side surfaces 86. Cutting insert 72 has a structure along the lines of at least one of the cutting inserts disclosed and described in pending U.S. patent application Ser. No. 09/591,644 to Dunn et al. filed on Jun. 9, 2000 for a DRILL BIT, HARD MEMBER AND BIT BODY, and such patent application is incorporated by reference herein.

Rotary drill bit 70 has an elongate bit body 90. Bit body 90 has an opposite top end (or distal end) 92 and bottom end (or proximate end) 94. Bit body 90 has a sidewall 96 that presents a generally cylindrical exterior surface 97 and contains an aperture 98. As mentioned in connection with the description of the connection between the rotary drill bit 20 and the drill steel, a projection on the drill steel registers with the aperture 98 so as to connect the rotary drill bit 70 to the drill steel. Bit body 90 defines an interior cavity 100. The bit body 90 contains at the top end 92 thereof a lobed socket 102.

Bit body 90 contains a helical debris port 108. Bit body 90 further includes a helical scalloped portion 110 that extends from the top end 92 in an axial rearward direction down along the exterior surface 97 of the bit body 90. The helical debris port 108 is located near, but axial forward of, the termination of the helical scalloped portion 110.

The helical scallop 110 has an orientation so as to have a pitch that equals about 3 inches (7.62 centimeters). The helical scallop 110 may have a pitch that ranges between about 3 inches (7.62 centimeters) and about 15 inches (38.1 centimeters). As an alternative range for the pitch, the helical scallop 110 may have a pitch that ranges between about 5 inches (12.7 centimeters) and about 10 inches (25.4 centimeters). As still another alternate range for the pitch, the helical scallop 110 may have a range of the pitch between about 6 inches (15.24 centimeters) and about 10 inches (25.4 centimeters). The orientation of the helical debris port 108 is such so that it has a pitch like that of the helical scallop 110.

In operation, the rotary drill bit 70 is pressed against the earth strata and is driven so as to rotate about its central longitudinal axis. The cutting insert 72 is in direct contact against the earth strata so as to drill a borehole. As a consequence of drilling the borehole, there is generated a volume of debris in the form of fine particles (i.e., dust) and larger particles. The debris is generated at and hence initially located in the vicinity of the cutting insert and the upper region of the rotary drill bit.

A vacuum is at the helical debris ports 108. Under the influence of the vacuum, the debris moves over the surface of the scalloped portion 110 into the corresponding debris port 108. The helical orientation of the debris port 108 and the helical scallop 110 facilitate the efficient and relatively quick evacuation of the debris from the vicinity of the rotary drill bit 70. The efficient and relatively quick evacuation of the debris from the vicinity of the rotary drill bit 70 provides for the advantages of higher drilling rates along with smoother drilling and cooler drilling.

Figure 8:
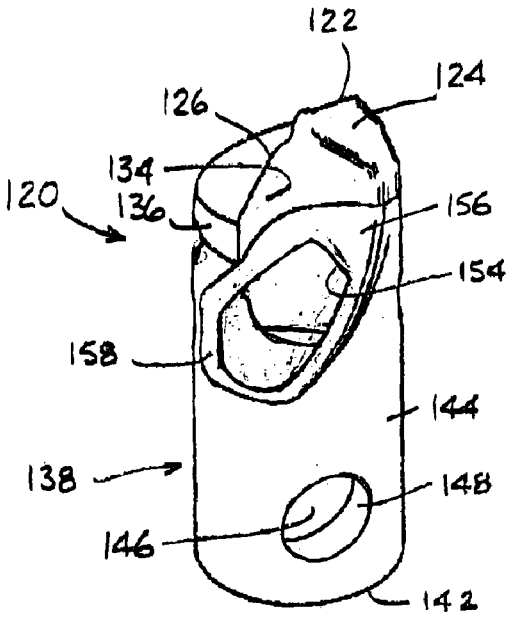
FIG. 8 is an isometric view of still another specific embodiment of the earth penetrating rotary drill bit of the invention wherein this embodiment has a cutting insert that has two lobes.
Figure 9:
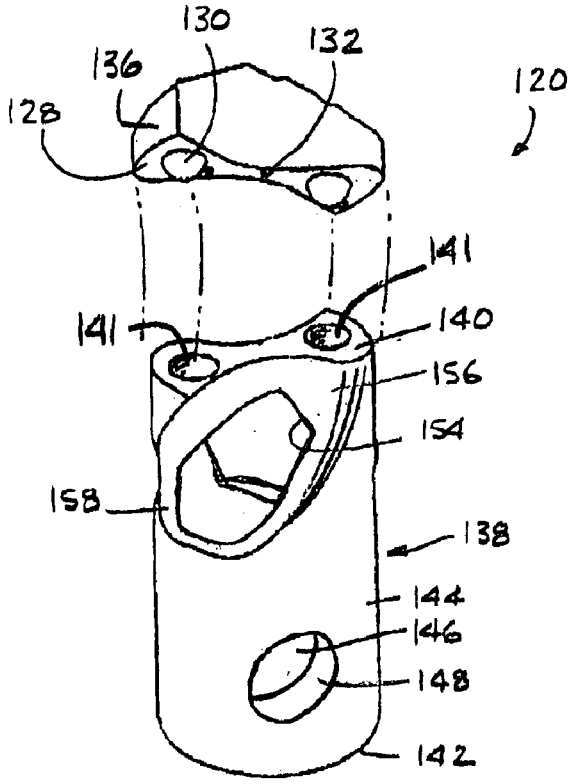
FIG. 9 is an isometric view of the earth penetrating rotary drill bit of FIG. 8 wherein the cutting insert is exploded away from the elongate rotary drill bit body so as to view the bottom surface of the cutting insert.
Figure 10:
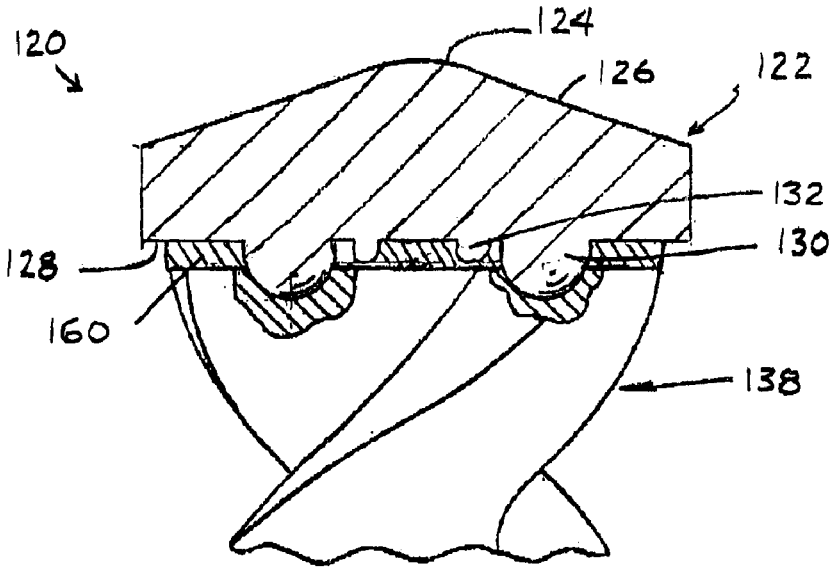
FIG. 10 is a cross-sectional view of the juncture between the cutting insert and the elongate rotary drill bit body of the embodiment of FIG. 8.

Referring to FIGS. 8 through 10, there is shown still another specific embodiment of a rotary drill bit generally designated as 120. Rotary drill bit 120 includes a hard carbide (e.g., cobalt cemented tungsten carbide) cutting insert 122. Cutting insert 122 includes a top surface 124 that presents cutting edges 126. Cutting insert 122 also has a bottom surface 128 that has positioning projections 130 and spacer bumps 132 extending therefrom. Cutting insert 122 has a transverse surface 134 and a peripheral side surface 136.

Rotary drill bit 120 further includes an elongate bit body 138 that has a top end (distal end) 140 and a bottom end (proximate end) 142. There are a pair of holes 141 in the top end 140 of the bit body 138. Bit body 138 further includes a sidewall 144 that presents an exterior surface 145. Bit body 138 defines an interior cavity 146 and contains an aperture 148. A projection on a drill steel registers with the aperture 140 so as to connect the rotary drill bit 120 to the drill steel.

Bit body 138 further contains a helical debris port 154 and a helical scallop 156. The helical scallop 156 has an orientation may have a pitch that ranges between about 3 inches (7.62 centimeters) and about 15 inches (38.1 centimeters). As an alternative range for the pitch, the helical scallop 156 may have a pitch that ranges between about 5 inches (12.7 centimeters) and about 10 inches (25.4 centimeters). As still another alternate range for the pitch, the helical scallop 156 may have a range of the pitch between about 6 inches (15.24 centimeters) and about 10 inches (25.4 centimeters). The orientation of the helical debris port 154 is such so that it has a pitch like that of the helical scallop 156.

There is a braze joint 160 between the cutting insert 122 and the top end 140 of the bit body 138. The holes 141 in the top end 140 of the bit body 138 receive the positioning projections 130 so as to help position the cutting insert 122 relative to the bit body 138. The spacer bumps 132 help maintain a pre-selected uniform thickness of the braze joint 160 between the cutting insert 122 and the top end 140 of the bit body 138.

In operation, the rotary drill bit 120 is pressed against the earth strata and is driven so as to rotate about its central longitudinal axis. The cutting insert 122 is in direct contact against the earth strata so as to drill a borehole. As a consequence of drilling the borehole, there is generated a volume of debris in the form of fine particles (i.e., dust) and larger particles. The debris is generated at and hence initially located in the vicinity of the cutting insert and the upper region of the rotary drill bit.

A vacuum is at the helical debris ports 154. Under the influence of the vacuum, the debris moves over the scallop surfaces 156 into the corresponding debris port 154. The helical orientation of the debris ports 154 and the helical scallops 156 facilitate the efficient and relatively quick evacuation of the debris from the vicinity of the rotary drill bit 120. The efficient and relatively quick evacuation of the debris from the vicinity of the rotary drill bit 120 provides for the advantages of higher drilling rates along with smoother drilling and cooler drilling.

It can thus be appreciated that the rotary drill bits disclosed and described herein provide certain improvements and advantages. These drill bits provide for the efficient and improved evacuation of debris from the vicinity of the rotary drill bit during the drilling operation. These rotary drill bits that provide for better evacuation of debris enhance the ability of the rotary drill bit to operate at a higher speed and provide for smoother and cooler operation.

One can appreciate that the present invention includes a method of making a rotary drill bit body comprising the steps of: providing a rotary drill bit body blank wherein the rotary drill bit body blank is either cast or cold-formed, and the rotary drill bit body blank having a helical scallop, and the rotary drill bit body blank further having a distal end containing a plug and a formed protrusion within the helical scallop; removing the plug so as to form a slot for receiving a cutting insert; and removing the formed protrusion so as to form a helical debris port.

One can also appreciate that the present invention provides for a method making a rotary dill bit. This method comprises the steps of: providing a drill bit body having a side wall and opposite ends, the drill bit body containing a helical debris port in the side wall thereof, and the drill bit body containing a helical scallop surrounding the debris port; providing a cutting insert; and affixing the cutting insert to the drill bit body at a distal one of the opposite ends thereof so that the helical scallop is proximate to the cutting insert so that debris from the drilling operation impinges upon the helical scallop whereby the helical scallop directs the debris into the helical debris port.

The patents and other documents identified herein are hereby incorporated by reference herein.

Other embodiments of the invention will be apparent to those skilled in the art from a consideration of the specification (including the drawings) or practice of the invention disclosed herein. It is intended that the specification and examples be considered as illustrative only, with the true scope and spirit of the invention being indicated by the following claims.

What is claimed is:

1. A drill bit for drilling earth strata whereby debris is generated during the drilling operation, the drill bit comprising:

a drill bit body having a side wall and opposite ends, a distal one of the opposite ends of the drill bit body receiving a cutting insert;

the drill bit body containing a helical debris port in the side wall thereof;

the drill bit body containing a helical scallop surrounding the debris port, the scallop presenting a pitch ranging between about 7.6 centimeters and about 38.1 centimeters; and the helical scallop being proximate to the cutting insert so that debris from the drilling operation impinges upon the helical scallop whereby the helical scallop directs the debris into the helical debris port.

2. The drill bit of claim 1 wherein the cutting insert being in the direct communication with the helical scallop.

3. The drill bit of claim 1 wherein the drill bit body presenting a feeder surface, and the feeder surfaces feeds the debris to the helical scallop.

4. The drill bit of claim 3 wherein the feeder surface is adjacent to the cutting insert.

5. The drill bit of claim 1 wherein the helical scallop presents a pitch that ranges between about 12.7 centimeters and about 25.4 centimeters.

6. The drill bit of claim 1 wherein the drill bit body is cold-formed.

7. The drill bit body of claim 1 wherein the drill bit body is cast.

8. The drill bit of claim 1 wherein the cutting insert presenting a plurality of lobes wherein each one of the lobes defines a cutting edge, and the drill bit body containing a plurality of the helical debris ports, and each one of the lobes having a corresponding helical debris port.

9. The drill bit of claim 1 wherein the cutting insert having a vertical orientation relative to the helical debris port so as to be within the vertical extension of a periphery of the helical debris port.

10. A drill bit for drilling earth strata so as to generate debris, the drill bit comprising:

a drill bit body having a side wall and opposite ends, a distal one of the opposite ends of the drill bit body receiving a cutting insert;

the drill bit body containing a helical debris port in the side wall thereof, and the drill bit body containing a helical scallop surrounding the debris port wherein the helical scallop presents a pitch ranging between about 7.6 centimeters and about 38.1 centimeters; and the distal end of the drill bit body presenting a feeder surface wherein the feeder surface is adjacent to the cutting insert, and debris from the drilling operation impinging upon the feeder surface so that the feeder surface feeds the debris into the helical scallop whereby the helical scallop directs the debris into the helical debris port.

11. The drill bit of claim 10 wherein the helical scallop presents a pitch that ranges between about 12.7 centimeters and about 25.4 centimeters.

12. The drill bit of claim 10 wherein the drill bit body as cold-formed.

13. The drill bit body of claim 10 wherein the drill bit body is cast.

14. A drill bit comprising:

a drill bit body having a side wall and opposite ends, a distal one of the opposite ends of the drill bit body receiving a cutting insert; and the drill bit body containing at least two helical debris ports in the side wall thereof; and the drill bit body containing a helical scallop corresponding to each one of the helical debris ports, each one of the helical scallops surrounding so as to define the periphery of its corresponding one of the helical debris ports and each of said scallops presenting a pitch ranging between about 7.6 centimeters and about 38.1 centimeters.

15. The drill bit of claim 14 wherein the cutting insert being in the direct communication with the helical scallop.

16. The drill bit of claim 14 wherein the drill bit body presenting a feeder surface, and the feeder surfaces feeds the debris to the helical scallop.

17. The drill bit of claim 14 wherein the helical scallop presents a pitch ranging between about 12.7 centimeters and about 25.4 centimeters.

18. The drill bit of claim 14 wherein the cutting insert having a vertical orientation relative to the helical debris port so as to be within the vertical extension of a periphery of the helical debris port.

19. A drill bit comprising:

a drill bit body having a side wall and opposite ends, a distal one of the opposite ends of the drill bit body receiving a cutting insert;

the drill bit body containing a helical debris port in the side wall thereof;

the drill bit body containing a helical scallop surrounding the helical debris port, the scallop defining a periphery of the debris port; and the helical scallops having a pitch ranging between about 7.62 centimeters and about 38.1 centimeters.

20. The drill bit of claim 19 wherein the cutting insert being in the direct communication with the helical scallop.

21. The drill bit of claim 19 wherein the drill bit body presenting a feeder surface, and the feeder surfaces feeds the debris to the helical scallop.

22. The drill bit of claim 19 wherein the feeder surface is adjacent to the cutting insert.

23. The drill bit of claim 19 wherein the cutting insert having a vertical orientation relative to the helical debris port so as to be within the vertical extension of a periphery of the helical debris port.

24. A cold-formed rotary drill bit body comprising:

a side, wall;

the side wall containing a helical scallop, and the helical scallop presenting a pitch ranging between about 7.6 centimeters and about 38.1 centimeters;

the side wall containing a helical debris port wherein the helical scallop surrounds the helical debris port; and opposite ends wherein a distal one of the opposite ends containing a slot for receiving a cutting insert.

25. The cold-formed rotary drill bit body of claim 24 further including an interior cavity in communication with the helical debris port.

26. The cold-formed rotary drill bit body of claim 24 comprising a pair of the helical scallops and a pair of the helical debris ports.

27. The cold-formed rotary drill bit body of claim 24 comprising a trio of the helical scallops and a trio of the helical debris ports.

28. The cold-formed rotary drill bit body of claim 24 wherein the helical scallop presenting a pitch ranging between about 12.7 centimeters and about 25.4 centimeters.

29. A cast rotary drill bit body comprising:

a side wall;

the side wall containing a helical scallop, and the helical scallop presenting a pitch ranging between about 7.6 centimeters and about 38.1 centimeters;

the side wall containing a helical debris port wherein the helical scallop surrounds the helical debris port; and opposite ends wherein a distal one of the opposite ends containing a slot for receiving a cutting insert.

30. The cast rotary drill bit body of claim 29 wherein the helical scallop presenting a pitch ranging between about 12.7 centimeters and about 25.4 centimeters.

* * * * *